US011149488B2

(12) United States Patent
Wang

(10) Patent No.: US 11,149,488 B2
(45) Date of Patent: Oct. 19, 2021

(54) SAFETY GATE

(71) Applicant: DEMBY DEVELOPMENT CO., LTD., New Taipei (TW)

(72) Inventor: Tsung Hsiang Wang, New Taipei (TW)

(73) Assignee: DEMBY DEVELOPMENT CO., LTD., New Taipei (TW)

( * ) Notice: Subject to any disclaimer, the term of this patent is extended or adjusted under 35 U.S.C. 154(b) by 193 days.

(21) Appl. No.: 16/554,763

(22) Filed: Aug. 29, 2019

(65) Prior Publication Data

US 2020/0340295 A1 Oct. 29, 2020

(30) Foreign Application Priority Data

Apr. 26, 2019 (CN) ..... 201920583470.3

(51) Int. Cl.
*E06B 9/04* (2006.01)
*E05B 65/00* (2006.01)
*E06B 9/00* (2006.01)

(52) U.S. Cl.
CPC ..... *E06B 9/04* (2013.01); *E05B 65/0007* (2013.01); *E05B 65/0014* (2013.01); *E06B 2009/002* (2013.01)

(58) Field of Classification Search
CPC .. E06B 9/04; E06B 2009/002; E05B 65/0014; E05B 65/0007
See application file for complete search history.

(56) References Cited

U.S. PATENT DOCUMENTS 4,702,036 A * 10/1987 Johnson ..... E06B 9/02 49/394
6,016,629 A * 1/2000 Sylvester ..... E05B 65/0007 49/394
6,112,460 A * 9/2000 Wagnitz ..... E06B 9/04 49/394
8,713,851 B2 * 5/2014 Flannery ..... E05B 65/0007 49/55
2010/0290830 A1 * 11/2010 Cheng ..... E06B 9/02 403/290

(Continued)

FOREIGN PATENT DOCUMENTS

GB 2499231 A * 8/2013 ..... E05B 63/24

*Primary Examiner* — Marcus Menezes
(74) *Attorney, Agent, or Firm* — Alan D. Kamrath; Karin L. Williams; Mayer & Williams PC

(57) ABSTRACT

A safety gate has two wall-mounted post assemblies, a main frame, and two connecting assemblies. The wall-mounted post assemblies are mounted on walls on two sides of the entrance. The main frame has a first frame portion, a second frame portion, and a sliding set. The sliding set connects the first frame portion and the second frame portion so the first frame portion and the second frame portion can slide with respect to each other to adjust an overlapping area. The connecting assemblies are mounted on two sides of the main frame and detachably mounted on the wall-mounted post assemblies. Therefore, the main frame is detachably mounted on the walls. Besides, the first frame portion and the second frame portion can be moved with respect to each other, so the occupied space is smaller and it is easy to control the blocked range of the entrance.

8 Claims, 8 Drawing Sheets

(56) References Cited

U.S. PATENT DOCUMENTS

| | | | | |
|---|---|---|---|---|
| 2012/0324796 | A1* | 12/2012 | Wang | E06B 9/0623 49/421 |
| 2014/0190641 | A1* | 7/2014 | Wang | E06B 9/06 160/222 |
| 2015/0089873 | A1* | 4/2015 | Marsden | E06B 9/02 49/56 |
| 2017/0058595 | A1* | 3/2017 | Marsden | E05B 65/0007 |
| 2017/0211314 | A1* | 7/2017 | Raffi | E06B 9/04 |
| 2017/0306693 | A1* | 10/2017 | Potter | E04B 2/7427 |
| 2019/0085620 | A1* | 3/2019 | Wang | E06B 9/0638 |
| 2020/0063488 | A1* | 2/2020 | Wang | E06B 9/04 |
| 2021/0079700 | A1* | 3/2021 | Wang | E05D 3/02 |

* cited by examiner

SAFETY GATE

CROSS-REFERENCE TO RELATED APPLICATIONS

This application is based upon and claims priority under 35 U.S.C. 119 from China Patent Application No. 201920583470.3 filed on Apr. 26, 2019, which is hereby specifically incorporated herein by this reference thereto.

BACKGROUND OF THE INVENTION

1. Field of the Invention

The present invention relates to a safety gate.

2. Description of the Prior Arts

A safety gate is mounted at an entrance of a building or an area for controlling access to the building or area.

The conventional safety gate and the wall-mounted post assemblies thereof are hard to be assembled and inconvenient to use because an occupied space of the conventional safety gate is large. Besides, a width of the conventional safety gate cannot be adjusted so the conventional safety gate cannot adapt to entrances with difference widths, which is also inconvenient.

To overcome the shortcomings, the present invention provides a safety gate to mitigate or obviate the aforementioned problems.

SUMMARY OF THE INVENTION

The main objective of the present invention is to provide a safety gate, the occupied space thereof being smaller and a blocked range of the entrance being adjustable.

The safety gate has two wall-mounted post assemblies, a main frame, and two connecting assemblies. The two wall-mounted post assemblies are respectively mounted on two walls of two sides of an entrance. The main frame is configured to block the entrance and comprises a first frame portion, a second frame portion, and at least one sliding set. The at least one sliding set connects the first frame portion and the second frame portion and thereby the first frame portion and the second frame portion are capable of sliding with respect to each other for adjusting an overlapping area of the first frame portion and the second frame portion. The two connecting assemblies are respectively mounted on two ends of the main frame. Each one of the connecting assemblies is detachably connected to a respective one of the wall-mounted post assemblies.

Therefore, with the aforesaid safety gate, the main frame is detachably connected on the walls on two sides of the entrance via the connecting assemblies and the wall-mounted post assemblies, so the main frame is easy to be detached. Besides, the first frame portion and the second frame portion are movably connected by the sliding set, and the overlapping area of the first frame portion and the second frame portion can be adjusted to block the entrance or let the entrance open. With the first frame portion and the second frame portion being movable in the extending directions thereof, compared to opening and closing the entrance via the pivotal first frame portion and the second frame portion, the occupied space is smaller and a blocked range of the entrance can be adjusted arbitrarily.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
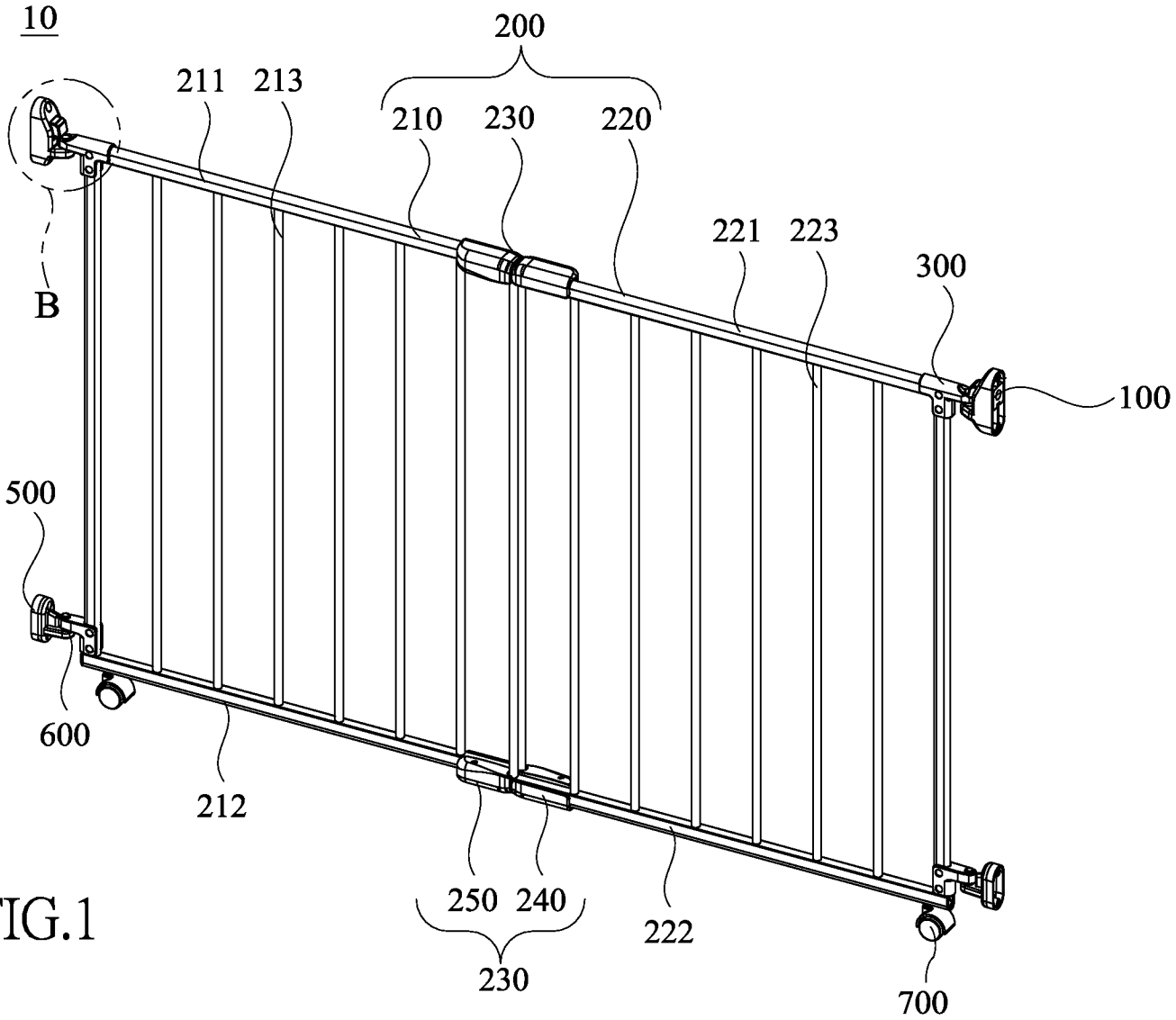
FIG. 1 is a perspective view of a safety gate in accordance with the present invention, shown in a first state.

In order to facilitate the understanding of the present invention, the present invention will be described more fully hereinafter with reference to the accompanying drawings. A preferred embodiment of the present invention is shown in the drawings. However, the invention may be embodied in many different forms and is not limited to the embodiments described herein. Rather, these embodiments are provided so that this disclosure will be more fully understood.

It should be noted that when a component is referred to as being "fixed" to another component, it can be directly mounted on said another component or still another component may be disposed between the component and said another component. When a component is considered to be "connected" to another component, it can be directly connected to said another component or still another component may be disposed between the component and said another component. The terms "vertical," "horizontal," "left," "right," and the like, as used herein, are for the purpose of illustration and are not intended to be the only embodiment.

All technical and scientific terms used herein have the same meaning as commonly understood by one of ordinary skill in the art. The terminology used in the description of the present invention is for the purpose of describing particular embodiments and is not intended to limit the invention. The term "and/or" used herein includes any and all combinations of one or more of the associated listed items.

Please refer to FIG. 1. The safety gate 10 of the present invention is configured to block an entrance.

One of the embodiments of the safety gate 10 of the present invention comprises at least one wall-mounted post assembly 100, a main frame 200, and at least one connecting assembly 300. The at least one wall-mounted post assembly 100 is mounted on a wall of the entrance and the at least one connecting assembly 300 is detachably mounted on the at least one wall-mounted post assembly 100.

The main frame 200 comprises a first frame portion 210, a second frame portion 220, and a sliding set 230. The first frame portion 210 and the second frame portion 220 are parallel to each other. The sliding set 230 connects the first frame portion 210 and the second frame portion 220, and thereby the first frame portion 210 and the second frame portion 220 are capable of sliding with respect to each other, which adjusts an overlapping area of the first frame portion 210 and the second frame portion 220. In this embodiment, an amount of the at least one wall-mounted post assembly 100 is two, and an amount of the at least one connecting assembly 300 is two. The two connecting assemblies 300 are respectively and securely mounted on two ends of the main frame 200 and respectively and detachably mounted on the two wall-mounted post assemblies 100.

In the aforesaid embodiment of the safety gate 10 of the present invention, the main frame 200 can be mounted on the walls via the connecting assemblies 300 and the wall-mounted post assemblies 100, and the main frame 200 is easy to be installed on or detached from the walls. Besides, the overlapping area of the first frame portion 210 and the second frame portion 220 can be adjusted via the sliding set 230, which blocks the entrance or lets the entrance open. The first frame portion 210 and the second frame portion 220 are capable of sliding with respect to each other in extending directions thereof, so the first frame portion 210 or the second frame portion 220 only can be moved along a straight line. Compared to a conventional safety gate which has a first frame portion and a second frame portion that can pivot with respect to each other to block or open the entrance, the safety gate 10 of the present invention has a smaller occupied space and a blocked range in the entrance can be adjusted arbitrarily.

In a preferred embodiment, the first frame portion 210 may comprise a first lateral rod 211, a second lateral rod 212, and a plurality of first support rods 213. Two ends of each one of the first support rods 213 are respectively connected to the first lateral rod 211 and the second lateral rod 212. Also, the second frame portion 220 may comprise a third lateral rod 221, a fourth lateral rod 222, and a plurality of second support rods 223. Two ends of each one of the second support rods 223 are respectively connected to the third lateral rod 221 and the fourth lateral rod 222.

Figure 2:
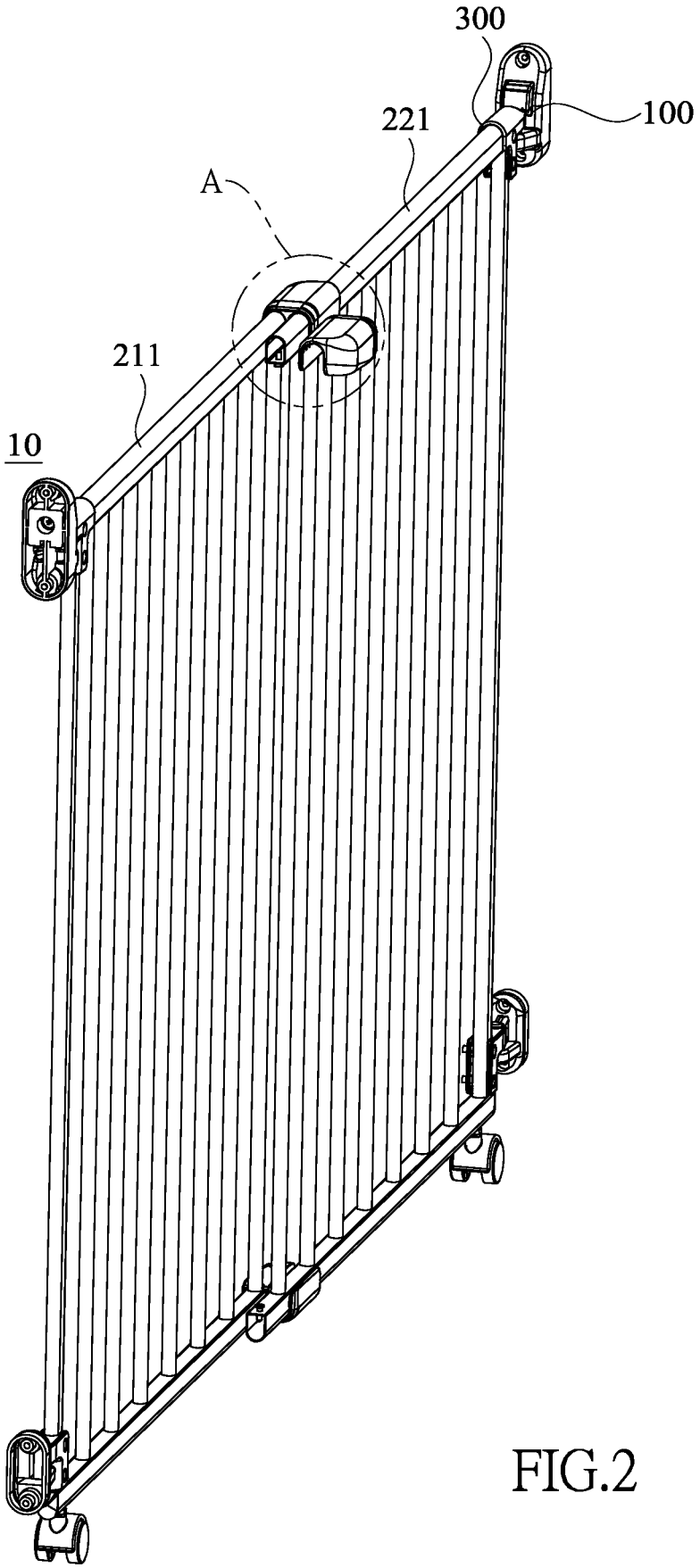
FIG. 2 is another perspective view of the safety gate in FIG. 1.
Figure 3:
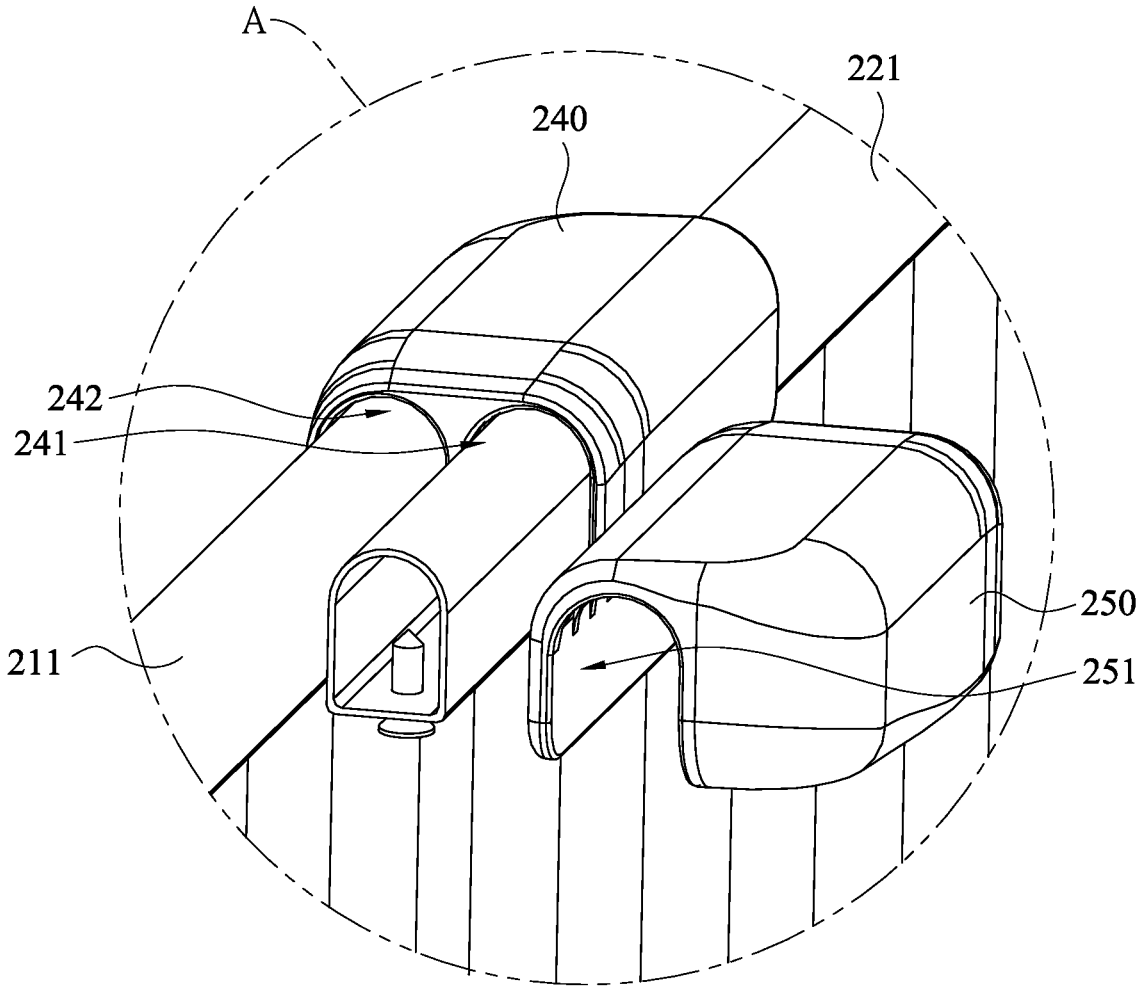
FIG. 3 is an enlarged view of the safety gate of a portion A in FIG. 2.

Then please also refer to FIG. 2 and FIG. 3. The sliding set 230 may comprise a first sliding component 240 and a second sliding component 250. The first sliding component 240 and the second sliding component 250 are connected to each other. The first sliding component 240 is mounted on one end of the first lateral rod 211 via a screw. The first sliding component 240 forms a first sliding channel 241 and a first fixing chamber 242, and the first fixing chamber 242 and the first sliding channel 241 extend parallel to each other. Said one end of the first lateral rod 211 is securely mounted in the first fixing chamber 242 and the third lateral rod 221 is movably mounted in the first sliding channel 241, so the first sliding component 240 and the first lateral rod 211 are capable of moving along the third lateral rod 221.

The second sliding component 250 is mounted on one end of the third lateral rod 221 via a screw. The second sliding component 250 forms a second sliding channel 251 and a second fixing chamber (not shown in the drawings), and the second fixing chamber and the second sliding channel 251 extend parallel to each other. Said one end of the third lateral rod 221 is securely mounted in the second fixing chamber and the first lateral rod 211 is movably mounted in the second sliding channel 251, so the second sliding component 250 and the third lateral rod 221 are capable of moving along the first lateral rod 211.

Also, the sliding set 230 may comprise another first sliding component 240 and another second sliding component 250 mounted on the second lateral rod 212 and the fourth lateral rod 222. Therefore, the second lateral rod 212 and the fourth lateral rod 222 are also connected and thereby the first frame portion 210 and the second frame portion 220 may slide more stably. Besides, if an upper part and a lower part of the first frame portion 210 or the second frame portion 220 slide simultaneously, at the same time, the entrance is open or is blocked at an upper side and a lower side. In other words, the first frame portion 210 or the second frame portion 220 may be moved entirely rather than leave a threshold when the entrance is open, which prevents people stumbling against the threshold.

Figure 4:
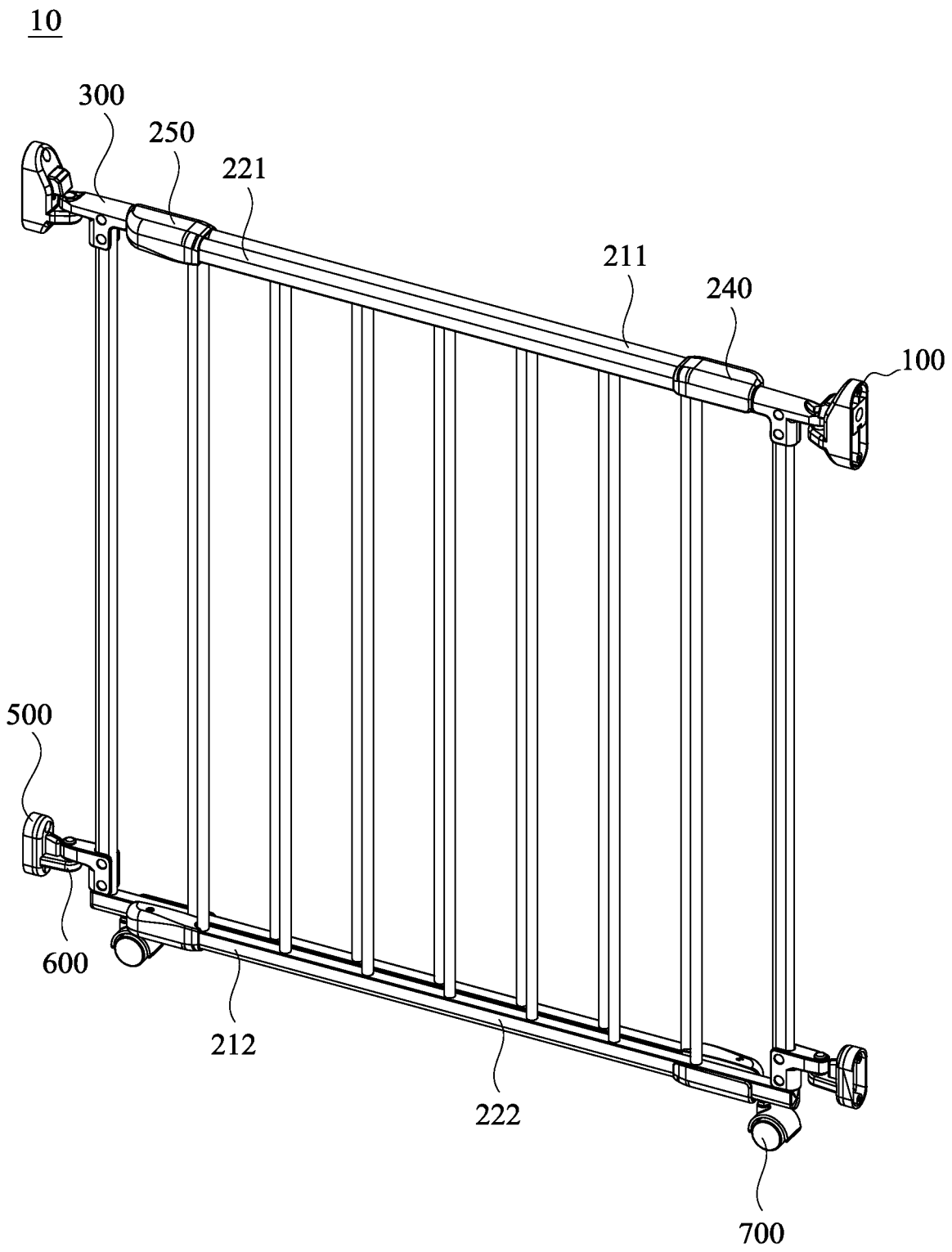
FIG. 4 is another perspective view of the safety gate in FIG. 1, shown in a second state.

In a preferred embodiment, the first frame portion 210 and the second frame portion 220 can be moved to a first state and a second state. Please refer to FIG. 1. In the first state, the first sliding component 240 and the second sliding component 250 abut each other and block the entrance. Then please refer to FIG. 4. In the second state, the overlapping area of the first frame portion 210 and the second frame portion 220 is the largest. An opened width of the entrance may equal to a width of the first frame portion 210 or the second frame portion 220. In this embodiment, the first state or the second state stands for limiting positions of the first frame portion 210 and the second frame portion 220. A user can open the entrance to a specific width, so the safety gate 10 can be used in various situations. Specifically, when the entrance is open or is blocked by the safety gate 10, the user can arbitrarily operate the first frame portion 210 or the second frame portion 220 to slide with respect to each other, so the safety gate 10 is convenient to use.

Figure 5:
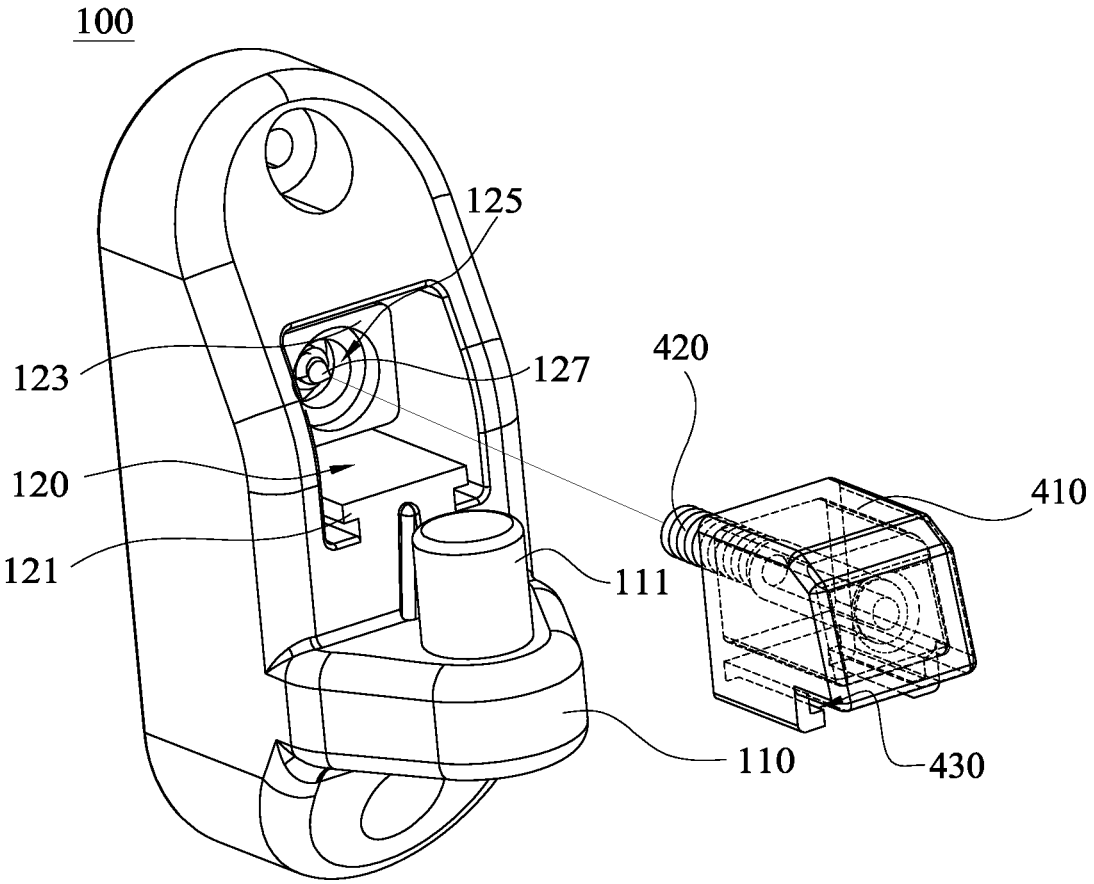
FIG. 5 is a perspective view of a stopping block and a wall-mounted post assembly of the safety gate in FIG. 1.
Figure 6:
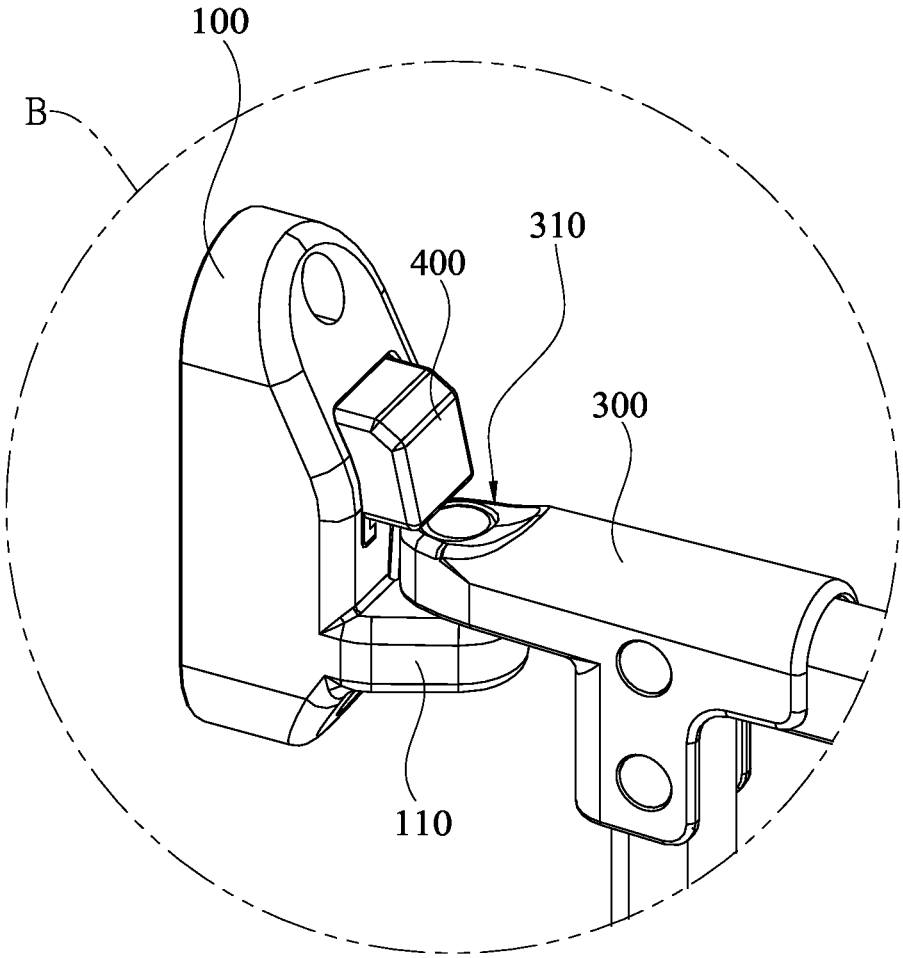
FIG. 6 is an enlarged view of the safety gate of a portion B in FIG. 1.

Then please refer to FIG. 5. In a preferred embodiment, a seat 110 is mounted on a side, near the main frame 200, of each one of the wall-mounted post assemblies 100. A connecting post 111 is mounted on the seat 110. Then also please refer to FIG. 6. Each one of the connecting assemblies 300 forms a connecting hole 310. The connecting hole 310 is located on and around the connecting post 111, which causes the connecting assembly 300 to be separated from the corresponding wall-mounted post assembly 100 easier. When someone wants to pass through the entrance, after one of the connecting assemblies 300 is separated from the connecting post 111, the user can move the first frame portion 210 or the second frame portion 220 to open the entrance partially, or detach the connecting assemblies 300 from the wall-mounted post assemblies 100 to open the entrance thoroughly and thus it is easier to pass through.

Precisely, the safety gate 10 is convenient to be installed and removed because of aforesaid structures of the wall-mounted post assemblies 100 and the connecting assemblies 300. Besides, the safety gate 10 can be installed at various circumstances. For example, normally, walls on two sides of an entrance may be parallel to each other, and thus the safety gate 10 may be installed normally. However, if walls on two sides of another entrance are staggered from each other, a frame portion of a conventional safety gate may be interfered by the walls when pivoted, so said safety gate cannot adapt to this circumstance. On the contrary, the safety gate 10 of the present invention is capable of being installed in such circumstance. Precisely, after the wall-mounted post assemblies 100 are mounted on the two walls on the two sides of the entrance and the connecting assemblies 300 are mounted on the wall-mounted post assemblies 100, because the first frame portion 210 and the second frame portion 220 can slide with respect to each other, the main frame 200 will not be interfered by the walls.

In another embodiment, the connecting assemblies 300 may be integrally formed on the first frame portion 210 or the second frame portion 220, or the safety gate 10 may not have any connecting assembly 300 but holes are formed on the first frame portion 210 and the second frame portion 220 to receive the connecting posts 111.

In this embodiment, the safety gate 10 may further comprise two stopping assemblies 400 mounted on a respective one of the wall-mounted post assemblies 100. Precisely, each one of the stopping assemblies 400 is mounted on a side of a corresponding one of the wall-mounted post assemblies 100. Said side of the wall-mounted post assembly 100 is close to the main frame 200. Each one of the stopping assemblies 400 is capable of extending elastically in the corresponding wall-mounted post assembly 100 and thereby is configured to limit the connecting assembly 300 connected on the corresponding wall-mounted post assembly 100 in position. Therefore, the connecting assemblies 300 and the wall-mounted post assemblies 100 are connected stably.

In a preferred embodiment, each one of the wall-mounted post assemblies 100 forms an installing chamber 120. The installing chamber 120 is configured to receive one of the stopping assemblies 400. Each one of the stopping assemblies 400 comprises a stopping block 410 and an elastic component 420. One end of the elastic component 420 is mounted in the installing chamber 120 and another end of the elastic component 420 is connected to the stopping block 410. The stopping block 410 and the seat 110 are spaced from each other. The elastic component 420 exerts an elastic force on the stopping block 410, which limits the connecting assembly 300 between the stopping block 410 and the seat 110 by the stopping block 410 and prevents the connecting assembly 300 from being detached from the connecting post 111.

Specifically, when the user wants to open the safety gate 10, the user may press the stopping block 410 to move the stopping block 410 away from the corresponding connecting assembly 300. After the stopping block 410 withdraws into the installing chamber 120, the user can lift the connecting assembly 300 to separate from the connecting post 111, and thereby the first frame portion 210 or the second frame portion 220 is detached from the corresponding wall-mounted post assembly 100. Then, the user pivots the first frame portion 210 or the second frame portion 220 to completely open the safety gate 10 of the present invention.

When the user does not want the safety gate 10 to block the entrance, just like opening the safety gate 10, the user may press the two stopping blocks 410 on both sides at the same time or successively make the first frame portion 210 separate from the corresponding wall-mounted post assembly 100 and the second frame portion 220 separate from the corresponding wall-mounted post assembly 100. Thus, the main frame 200 can be detached.

When the user wants to mount the main frame 200 on the wall-mounted post assemblies 100, the user can press the stopping blocks 410 to respectively move away from the corresponding connecting assemblies 300 so that the stopping blocks 410 withdraw into the corresponding installing chambers 120. Then, the user respectively sleeves the connecting assemblies 300 on the connecting posts 111 and releases the stopping blocks 410, such that the stopping blocks 410 move toward the corresponding connecting assembly 300 via the elastic components 420 and extend out of the corresponding installing chambers 120. Therefore, the connecting assemblies 300 are limited between the stopping blocks 410 and the corresponding seats 110. In other words, the connecting assemblies 300 are fixed, i.e., the first frame portion 210 and the second frame portion 220 are respectively locked on the corresponding wall-mounted post assemblies 100, and thereby the safety gate is installed completely.

Figure 7:
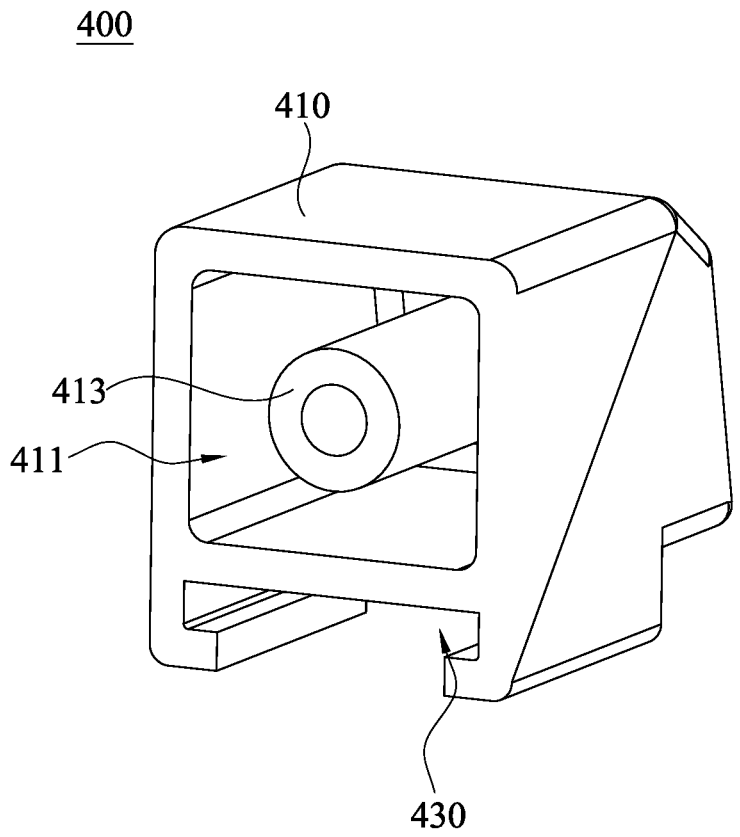
FIG. 7 is a perspective view of the stopping block of the safety gate in FIG. 1.

Then please refer to FIG. 5 and FIG. 7. In a preferred embodiment, each one of the installing chambers 120 comprises a guiding track 121 on a bottom surface of the installing chamber 120. Each one of the stopping blocks 410 comprises a slide slot 430 connected to the guiding track 121. The slide slot 430 is capable of sliding with respect to the connected guiding track 121, which guides the guiding block 410 during moving in the installing chamber 120 and will not deviate.

Further, each one of the stopping blocks 410 forms a guiding chamber 411 and each one of the installing chambers 120 comprises a guiding block 123 therein. The sectional shape and sectional size of the guiding block 123 and the sectional shape and sectional size of the guiding chamber 411 are the same. Each one of the elastic components 420 connects a respective one of the guiding chambers 411 and a respective one of the guiding blocks 123. The guiding chamber 411 and the guiding block 123 are configured to guide the stopping block 410 together, which prevents the stopping block 410 from deviating from a predetermined direction during movement. Therefore, the stopping block 410 can be moved in the installing chamber 120 stably.

In a preferred embodiment, the guiding block 123 comprises an installing hole 125 and a first guiding component 127. The first guiding component 127 is mounted in the installing hole 125. The stopping blocks 410 each comprise a second guiding component 413 in the guiding chamber 411. One end of the elastic component 420 is mounted on the first guiding component 127 and another end of the elastic component 420 is mounted on the second guiding component 413, which guides the elastic component 420 and prevents the elastic component 420 from being bent during compression or stretching.

Figure 8:
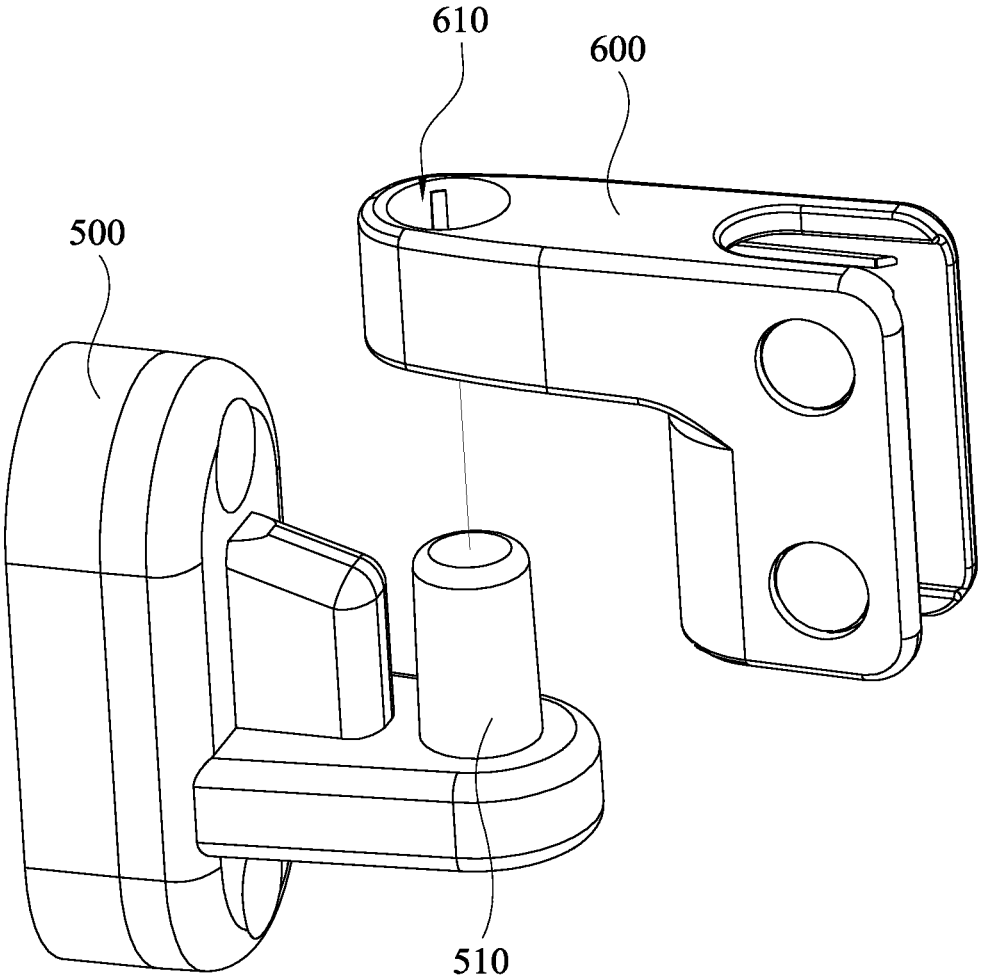
FIG. 8 is a perspective view of a first auxiliary connecting assembly and a second auxiliary connecting assembly.

Then please refer to FIG. 1 and FIG. 8. In a preferred embodiment, the safety gate 10 of the present invention further comprises at least one first auxiliary connecting assembly 500 and at least one second auxiliary connecting assembly 600. Each one of the at least one first auxiliary connecting assembly 500 and one of the wall-mounted post assemblies 100 are spaced from each other and located in the same vertical line. Each one of the at least one second auxiliary connecting assembly 600 is mounted on the main frame 200 and spaced from the connecting assembly 300 in another vertical line. The at least one first auxiliary connecting assembly 500 and the at least one second auxiliary connecting assembly 600 are pivotally and detachably connected to each other. Also, each one of the at least one first auxiliary connecting assembly 500 comprises an auxiliary column 510, and each one of the at least one second auxiliary connecting assembly 600 forms an auxiliary hole 610. The auxiliary hole 610 is located on and around the auxiliary column 510. With the auxiliary column 510 sleeved in the auxiliary hole 610, the main frame 200 can be fixed on the wall-mounted post assemblies 100 more stably. Precisely, an amount of the at least one first auxiliary connecting assembly 500 is two. The two first auxiliary connecting assemblies 500 are mounted on the two walls of the entrance respectively and spaced from the two wall-mounted post assemblies 100. An amount of the at least one second auxiliary connecting assembly 600 is two. The two second auxiliary connecting assemblies 600 are respectively mounted on the first support rod 215 and the second support rod 225 and configured to stabilize the first frame portion 210 and the second frame portion 220. In another embodiment, the amounts of the first auxiliary connecting assembly 500 and the second auxiliary connecting assembly 600 are not limited thereto.

Then please refer to FIG. 1. In a preferred embodiment, the safety gate 10 may comprise a wheel 700. The wheel 700 is mounted on a side, away from the connecting assembly 300, of the main frame 200, which reduces the resistance of the main frame 200 during opening or closing. Precisely, the safety gate 10 may have multiple wheels 700 respectively mounted to one end, close to the corresponding wall-mounted post assembly 100, of the second lateral rod 213, and one end, close to the other corresponding wall-mounted post assembly 100, of the fourth lateral rod 222, and a portion where the second lateral rod 212 and the fourth lateral rod 222 are connected. Therefore, the first frame portion 210 or the second frame portion 220 may be moved smoothly.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A safety gate comprising:

two wall-mounted post assemblies respectively mounted on two walls of two sides of an entrance;

a main frame configured to block the entrance and comprising:

a first frame portion;

a second frame portion; and two sliding sets connecting the first frame portion and the second frame portion and thereby the first frame portion and the second frame portion being capable of sliding with respect to each other for adjusting an overlapping area of the first frame portion and the second frame portion; and two connecting assemblies respectively mounted on two ends of the main frame; each one of the connecting assemblies detachably connected to a respective one of the wall-mounted post assemblies; wherein:

each one of the two sliding sets comprises:

a first sliding component securely mounted on one end of the first frame portion and forming:

a first sliding channel; the second frame portion movably mounted in the first sliding channel; and a second sliding component securely mounted on one end of the second frame portion and forming:

a second sliding channel; the first frame portion movably mounted in the second sliding channel;

when the first sliding component is pushed, the first frame portion moves with respect to the second frame portion; when the second sliding component is pushed, the second frame portion moves with respect to the first frame portion;

the first frame portion comprises:

a first lateral rod;

a second lateral rod; and a plurality of first support rods, two ends of each one of the first support rods respectively connected to the first lateral rod and the second lateral rod;

the second frame portion comprises:

a third lateral rod;

a fourth lateral rod; and a plurality of second support rods, two ends of each one of the second support rods respectively connected to the third lateral rod and the fourth lateral rod;

the first sliding components of the two sliding sets are respectively securely mounted on the first lateral rod and the second lateral rod, and the third lateral rod and the fourth lateral rod are respectively movably mounted in the first sliding channels of the first sliding components of said sliding sets;

the second sliding components of the two sliding sets are respectively securely mounted on the third lateral rod and the fourth lateral rod, and the first lateral rod and the second lateral rod are respectively movably mounted in the second sliding channels of the second sliding components of said sliding sets;

in each one of the two sliding sets:

the first sliding component further forms:

a first fixing chamber extending parallel to the first sliding channel; one end of the first lateral rod securely mounted in the first fixing chamber; and the second sliding component further forms:

a second fixing chamber extending parallel to the second sliding channel; one end of the second frame portion securely mounted in the second fixing chamber;

the safety gate further comprises:

two stopping assemblies each respectively mounted on a corresponding one of the two wall-mounted post assemblies; each one of the stopping assemblies mounted on a side, which is close to the main frame, of the corresponding wall-mounted post assembly and capable of extending elastically in the corresponding wall-mounted post assembly, thereby configured to limit the respective connecting assembly connected to said wall-mounted post assembly;

each one of the wall-mounted post assemblies forms:

an installing chamber configured to receive the corresponding stopping assembly;

each one of the stopping assemblies comprises:

a stopping block; and an elastic component, one of two ends of the elastic component mounted in the installing chamber of the corresponding wall-mounted post assembly and another one of the two ends of the elastic component connected to the stopping block so that an elastic force of the elastic component is exerted on the stopping block;

the installing chamber of each one of the wall-mounted post assemblies comprises:

a guiding track at a bottom surface of the installing chamber; and the stopping block of each one of the stopping assemblies comprises:

a slide slot connected to the guiding track of the corresponding wall-mounted post assembly and capable of sliding with respect to the guiding track.

2. The safety gate as claimed in claim 1, wherein the first frame portion and the second frame portion have:

a first state; in the first state, the first sliding component and the second sliding component abut each other; and a second state; in the second state, the overlapping area of the first frame portion and the second frame portion being the largest overlapping area of the first frame portion and the second frame portion.

3. The safety gate as claimed in claim 2, wherein:

each one of the wall-mounted post assemblies comprises:

a seat on a side, which is close to the main frame, of said wall-mounted post assembly; and a connecting post on the seat;

each one of the connecting assemblies comprises:

a connecting hole; the connecting post of each one of the wall-mounted post assemblies mounted in the connecting hole of the connecting assembly.

4. The safety gate as claimed in claim 3, wherein:

the stopping block of each one of the stopping assemblies comprises:

a guiding chamber;

each one of the wall-mounted post assemblies comprises:

a guiding block in the installing chamber and matching the guiding chamber of the stopping assembly in shape;

the elastic component of each one of the stopping assemblies connects the guiding chamber of the stopping assembly and the guiding block of the wall-mounted post assembly.

5. The safety gate as claimed in claim 4 further comprising:

a wheel mounted on a side, away from the connecting assemblies, of the main frame.

6. The safety gate as claimed in claim 1, wherein:

each one of the wall-mounted post assemblies comprises:

a seat on a side, which is close to the main frame, of said wall-mounted post assembly; and a connecting post on the seat;

each one of the connecting assemblies comprises:

a connecting hole; the connecting post of each one of the wall-mounted post assemblies mounted in the connecting hole of the connecting assembly.

7. The safety gate as claimed in claim 1, wherein:

the stopping block of each one of the stopping assemblies comprises:

a guiding chamber;

each one of the wall-mounted post assemblies comprises:

a guiding block in the installing chamber and matching the guiding chamber of the stopping assembly in shape;

the elastic component of each one of the stopping assemblies connects the guiding chamber of the stopping assemblies and the guiding block of the wall-mounted post assembly.

8. The safety gate as claimed in claim 1 further comprising:

a wheel mounted on a side, away from the connecting assemblies, of the main frame.

* * * * *